US009359931B2

(12) United States Patent
Sugano

(10) Patent No.: US 9,359,931 B2
(45) Date of Patent: Jun. 7, 2016

(54) GAS RELEASE APPARATUS FOR CONSTRUCTION MACHINE

(71) Applicant: KOBELCO CONSTRUCTION MACHINERY CO., LTD., Hiroshima-shi (JP)

(72) Inventor: Takao Sugano, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/485,966

(22) Filed: Sep. 15, 2014

(65) Prior Publication Data

US 2015/0101320 A1 Apr. 16, 2015

(30) Foreign Application Priority Data

Oct. 15, 2013 (JP) ..... 2013-214358

(51) Int. Cl.

| | |
|---|---|
| ***F01N 3/05*** | (2006.01) |
| ***F01P 1/00*** | (2006.01) |
| ***F01N 13/14*** | (2010.01) |
| ***E02F 9/08*** | (2006.01) |
| ***F01N 13/08*** | (2010.01) |

(52) U.S. Cl.

CPC ..... *F01P 1/00* (2013.01); *E02F 9/0866* (2013.01); *F01N 13/082* (2013.01); *F01N 13/14* (2013.01); *F01N 2260/20* (2013.01); *F01N 2260/22* (2013.01); *F01N 2470/04* (2013.01); *F01N 2590/08* (2013.01); *F01P 2001/005* (2013.01)

(58) Field of Classification Search

CPC ..... F01N 3/005; F01N 3/05; F01N 3/055; F01N 13/082; F01N 13/085; F01N 2260/022; F01N 2260/20; F01N 2270/02; F01N 2290/06; F01N 1470/02; F01N 1/14; F01N 13/143; F01N 2260/02; F01N 2260/22; F01N 2270/06; F01N 2270/08; F01N 2270/30; F01P 2001/005; B60K 11/06; B60K 11/08; B60K 13/04

See application file for complete search history.

(56) References Cited

U.S. PATENT DOCUMENTS 5,689,953 A * 11/1997 Yamashita ..... B60K 11/02 123/41.49
5,704,643 A * 1/1998 Yamanaka ..... B60K 5/06 180/68.4

(Continued)

FOREIGN PATENT DOCUMENTS

JP 3-229907 10/1991
JP 2 578 755 A2 4/2013

(Continued)

OTHER PUBLICATIONS

Extended European Search Report issued Mar. 16, 2015 in Patent Application No. 14184751.7.

*Primary Examiner* — Jonathan Matthias
(74) *Attorney, Agent, or Firm* — Oblon, McClelland, Maier & Neustadt, L.L.P.

(57) ABSTRACT

Provided is an apparatus which is capable of excellently mixing exhaust gas discharged from an engine with exhaust air to thereby improve lowering of temperature of the exhaust gas and suppression of noise. The apparatus comprises: a duct provided beneath an engine and having an upper edge surrounding an exhaust air inlet; an exhaust-gas pipe having an intra-duct portion extend inside the duct in a direction approximately perpendicular to a flow direction of the exhaust air; and an exhaust-gas-pipe cover provided just above the intra-duct portion to protect the intra-duct portion from oil which can drop down from above.

8 Claims, 5 Drawing Sheets

(56) References Cited

U.S. PATENT DOCUMENTS

| | | | |
|---|---|---|---|
| 2013/0081887 | A1 | 4/2013 | Tsuchihashi et al. |
| 2014/0144717 | A1 | 5/2014 | Nakashima et al. |
| 2014/0151143 | A1 | 6/2014 | Nakashima et al. |

FOREIGN PATENT DOCUMENTS

| | | | |
|---|---|---|---|
| JP | 2 578 755 | A3 | 4/2013 |
| WO | WO 2013/011665 | A1 | 1/2013 |
| WO | WO 2013/011666 | A1 | 1/2013 |

* cited by examiner

GAS RELEASE APPARATUS FOR CONSTRUCTION MACHINE

BACKGROUND OF THE INVENTION

1. Field of the Invention

The present invention relates to an apparatus provided in a construction machine, such as a hydraulic excavator, equipped with an engine and an engine room, to release exhaust gas of the engine and air having been used for cooling, to an outside of the engine room.

2. Description of the Background Art

The background art will be described by taking a hydraulic excavator as an example.

A typical hydraulic excavator comprises a crawler-type lower traveling body, an upper slewing body mounted on the lower traveling body in such a manner as to be slewable about an axis perpendicular to a ground surface, and a work attachment attached to the upper slewing body. An engine room is provided in a rear end region of the upper slewing body, and, in the engine room, an engine and its related devices (a cooling fan, a muffler, a heat exchanger, etc.) are installed.

This type of hydraulic excavator is provided with an apparatus for releasing, to an outside of the engine room, exhaust gas from the engine and exhaust air, that is, air having been sucked into the engine room by the cooling fan and used for cooling of the heat exchanger and the like. A heretofore-known example of this apparatus is disclosed in JP 03-229907A (Patent Literature 1).

FIG. 8 shows a technique disclosed in the Patent Literature 1. FIG. 8 is a schematic diagram of an engine room 1, when viewed forwardly from therebehind. The engine room 1 accommodates an engine 2, a cooling fan 3 configured to be driven by the engine 2, and a heat exchanger 4 such as a radiator. The engine room 1 includes an engine cover which covers the engine 2 from thereabove, an air suction port 5 and a gas release port 6. The fan 3 and the heat exchanger 4 are disposed in adjacent relation to a first one of opposite axial ends of the engine 2. The air suction port 5 and the gas release port 6 are provided in regions of the engine cover on the side of the first axial end and on the side of the other, second, axial end, respectively. The fan 3 is configured to be rotated to thereby perform: introducing outside air through the air suction port 5; making the introduced air pass through the heat exchanger 4; and releasing the air having been used for cooling, namely, exhaust air, through the gas release port 6.

A muffler 7 is provided at the second axial end of the engine 2, and exhaust gas discharged from the engine 2 is released to the outside via the muffler 7 and a tail pipe connected to muffler 7, namely, exhaust-gas pipe 8. This exhaust gas, having a high temperature, may deteriorate a surrounding temperature environment if being directly released through the exhaust-gas pipe 8 to the outside. Moreover, the direct release of exhaust gas and exhaust air makes leakage of operating noise, such as engine noise, exhaust gas noise and exhaust air noise, be significant.

For the above reason, the hydraulic excavator using the above heretofore-known technique additionally comprises a tubular-shaped duct 9 shown in FIG. 8. The duct 9 is disposed inside the engine room 1 at a position beneath the gas release port 6, in such a posture that the duct 9 vertically extends and upper and lower ends thereof are opened to the gas release port 6 and the inside of the engine room 1, respectively. Besides, the exhaust-gas pipe 8 has a distal end portion, which is inserted into the duct 9 so as to extend upwardly to serve as an ejection pipe 8a, allowing exhaust to be ejected from an opening of the distal end of the ejection pipe 8a into the duct 9. The thus ejected exhaust gas is mixed with exhaust air within the duct 9. This enables the exhaust gas released to the outside to have lowered temperature and enables operation noise to be reduced in the duct.

However, the intensive ejection of exhaust gas from extremely restricted area, namely, the distal end opening of the upwardly-extending ejection pipe 8a, causes efficiency of mixing between exhaust gas and exhaust air to be deteriorated, thus suppressing a drop in temperature of the exhaust gas. Besides, the straightforward ejection of the exhaust gas from the distal end opening of the ejection pipe 8a toward the gas release port 6 does not allow a significant effect on reduction in exhaust gas noise through the duct 9 to be expected.

SUMMARY OF THE INVENTION

It is an object of the present invention to provide a gas release apparatus for a construction machine, capable of excellently mixing exhaust gas discharged from an engine with exhaust air to thereby improve lowering temperature of the exhaust gas and suppression of noise.

Provided by the present invention is an apparatus which is provided in a construction machine equipped with an engine and an engine room housing the engine to release exhaust gas of the engine to an outside of the engine room. The apparatus comprises: a duct provided inside the engine room at a position beneath the engine, the duct having an upper end which surrounds an exhaust air inlet; a cooling fan configured to cause air outside the engine room to be sucked into the engine room as cooling air and then released as exhaust air to an outside of the engine room through the duct; an exhaust-gas pipe designed to introduce exhaust gas of the engine into the duct and having an intra-duct portion which extends, in the duct, in a length direction approximately perpendicular to a flow direction of the exhaust air passing through the duct, the intra-duct portion having a plurality of ejection holes spaced in the length direction to allow the exhaust gas to be ejected into the duct through the ejection holes to thereby let the ejected exhaust gas be released to the outside together with the exhaust air; and an exhaust-gas-pipe cover provided inside the duct at a position upwardly apart from the intra-duct portion to protect the intra-duct portion from oil which can drop down to the intra-duct portion.

DESCRIPTION OF EMBODIMENTS

Figure 1:
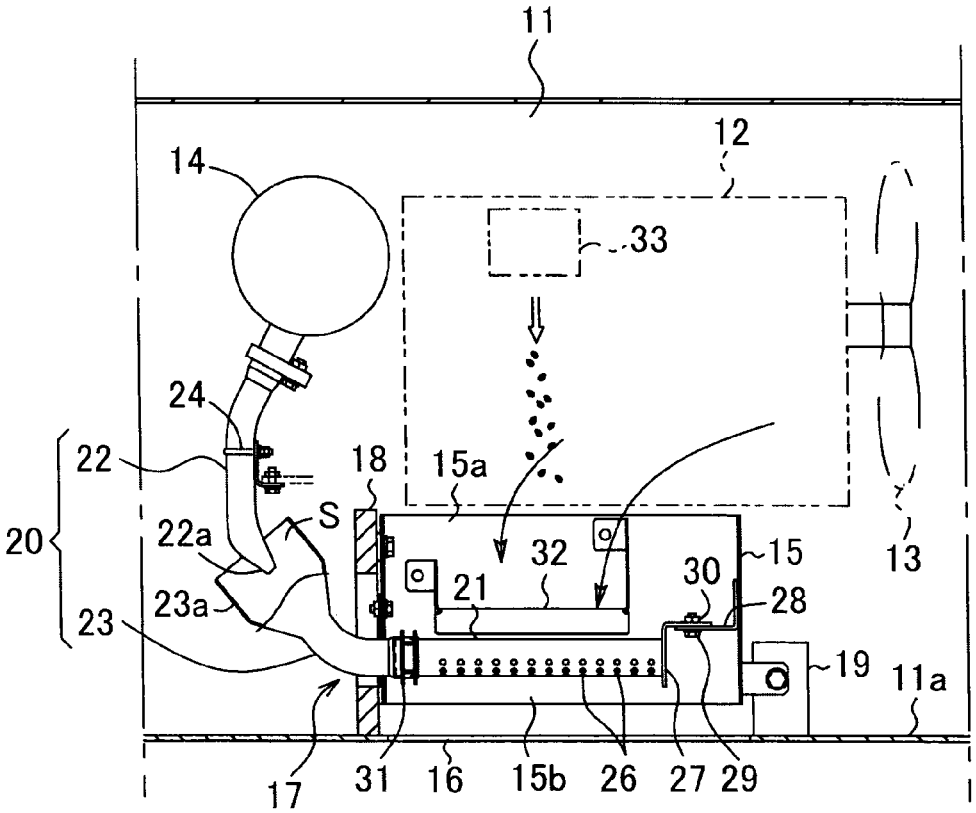
FIG. 1 is a sectional back view showing an inside of an engine room having a gas release apparatus according to a first embodiment of the present invention.

With reference to FIGS. 1 to 7, principal embodiments of the present invention will be described. All of the following embodiments are examples in which the present invention is applied to a hydraulic excavator including an upper slewing body, an engine room 11 mounted on the upper slewing body, and an engine 12 housed in the engine room 11. The engine room 11 has an air suction port which is not graphically shown and a gas release port 16 which is provided in a bottom wall 11*a* of the engine room 11.

FIGS. 1 to 4 show a gas release apparatus according to a first embodiment of the present invention. The gas release apparatus comprises a cooling fan 13, a generally rectangular tubular shaped duct 15, and an exhaust-gas pipe 17, all of which are installed in the engine room 11 together with other engine-related devices such as a muffler 14 and a non-graphically-shown heat exchanger. In the following description, the terms "right" and "left" used in connection with components including the duct 15 and the exhaust-gas pipe 17 is on the basis of the right-left direction in FIG. 1.

The cooling fan 13 is configured to be rotationally driven by the engine 12 to thereby cause air outside the engine room 11 to be sucked into the engine room 11 through the air suction port so as to cool the heat exchanger and then cause the air having been used for the cooling to be released as exhaust air from the gas release port 16 to the outside of the engine room 11 through the tubular shaped duct 15.

The duct 15 is provided at a position just above the gas release port 16 and beneath the engine 12, disposed so as to allow the exhaust air to flow therethrough downwardly. Specifically, the duct 15, having an upper edge surrounding an exhaust air inlet 15*a* to define it and a lower edge surrounding an exhaust air outlet 15*b* to define it, is disposed so as to allow the exhaust air to be flowed from the exhaust air inlet 15*a* to the exhaust air outlet 15*b* and released through the gas release port 16, that is, so as to make the exhaust air outlet 15*b* face the gas release port 16. The duct 15 is mounted to the engine room 11 through a plurality of duct-mounting members 18, 19 shown in FIGS. 1 and 2. The duct-mounting members 18, 19 couple respective left and right wall portions of the duct 15 to a wall of the engine room 11. A part of walls constituting the duct 15 may be formed by use of another component. For example, a back wall portion of the duct 15 may be formed by a front surface portion of a counterweight provided in a rear end region of the upper slewing body rearward of the engine room 11.

The exhaust-gas pipe 17 is connected to the muffler 14 and installed so as to introduce exhaust gas discharged from the engine 12 through the muffler 14 into the duct 15 to mix the exhaust gas with the exhaust air within the duct 15, the mixed gas being released to the outside of the engine room 11.

The exhaust-gas pipe 17 according to the first embodiment is given the following configuration for suppression of vibration and securement of required strength in the exhaust-gas pipe 17.

The exhaust-gas pipe 17 includes an ex-duct portion 20 located outside the duct 15 and an intra-duct portion 21 located inside the duct 15, the two portions 20, 21 being interconnected.

The ex-duct portion 20 is divided into a first segment 22 and a second segment 23. The first segment 22 has an upstream-side basal end connected to the muffler 14 and a downstream-side distal end 22*a* on a side opposite to the basal end. The second segment 23 has an upstream-side basal end 23*a* connected to the distal end 22*a* of the first segment 22, and a downstream-side distal end connected to the intra-duct portion 21.

The basal end 23*a* of the second segment 23 is formed in a funnel-like shape having a maximum inner diameter greater than an outer diameter of the distal end of the first segment 22. The distal end 22*a* of the first segment 22 is loosely inserted into the basal end 23*a* with a diametrical gap S (indicated in FIG. 1) therebetween. The first and second segments 22, 23 are thus separatably interconnected and permitted to make a relative displacement of the first and second segments 22, 23 to each other in a length direction and a diametrical direction (i.e., in an up-down direction and a right-left direction), within a range corresponding to the gap S. The basal end 23*a* of the second segment 23 is leftward tilted as shown in FIG. 1, the tilt allowing the relative positions of the first and second segments 22, 23 to each other to be adjusted simultaneously in both of the length and diametrical directions. Furthermore, a size of the gap S in the diametrical direction may be set to be greater than a maximum vibration amplitude of the first and second segments 22, 23, which allows the vibration of the first segment 22, for example, even the vibration caused by the resonation of an engine vibration system including the first segment 22, to be prevented from being transmitted to the second segment 23. Besides, the distal end 22*a* of the first segment 22 may be formed as a tapered nozzle portion.

In this embodiment, the first segment 22 and the second segment 23 in the ex-duct portion 20 are supported by the engine room 11 and the duct 15, respectively. Specifically, the first segment 22 is coupled to an appropriate region of the wall of the engine wall 11 through a clamp member 24 shown in FIG. 1. As to the second segment 23, the distal end portion thereof penetrates through the left wall portion of the duct 15 to partially protrudes into an inside of the duct 15, and the protruding portion is supported by a support plate 25 attached to the left wall portion as shown in FIGS. 2 and 3.

The intra-duct portion 21 is disposed inside the duct 15 so as to extend in the right-left direction. In other words, the intra-duct portion 21 extends approximately perpendicularly to a direction in which the exhaust air is flowed through the duct 15. The term "approximately perpendicularly" herein means not only "exactly perpendicularly" but also "slightly downwardly inclined toward an after-mentioned left or right end of the intra-duct portion 21".

The intra-duct portion 21 has a plurality of ejection holes 26. The ejection holes 26 are provided in a lower half of the intra-duct portion 21, over approximately the overall length of the intra-duct portion 21, and spaced in a circumferential direction and a length direction of the intra-duct portion 21, allowing the exhaust gas to be ejected into the duct 15 through the ejection holes 26 and released to the outside together with the exhaust air.

Figure 2:
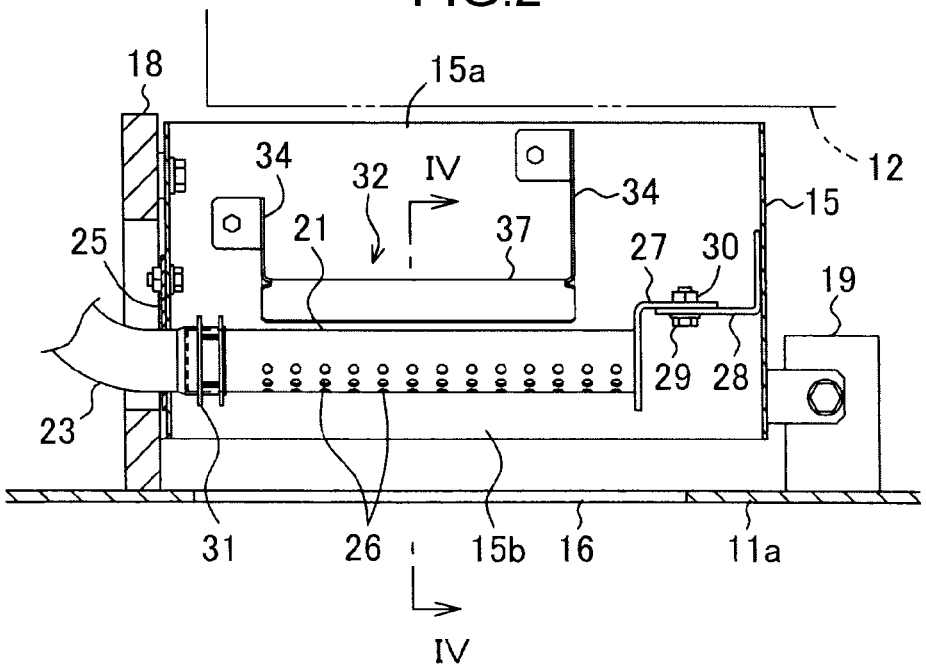
FIG. 2 is a sectional view of an inside of a duct shown in FIG. 1.
Figure 3:
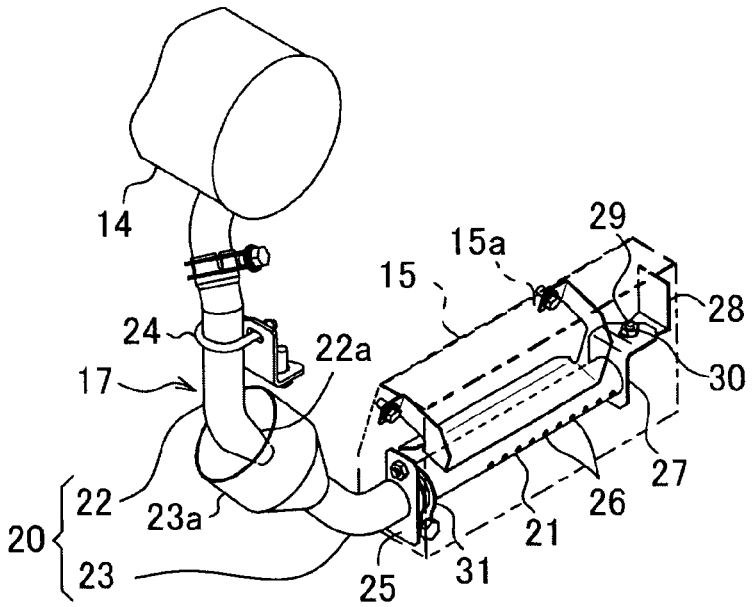
FIG. 3 is a perspective view of the gas release apparatus according to the first embodiment.
Figure 4:
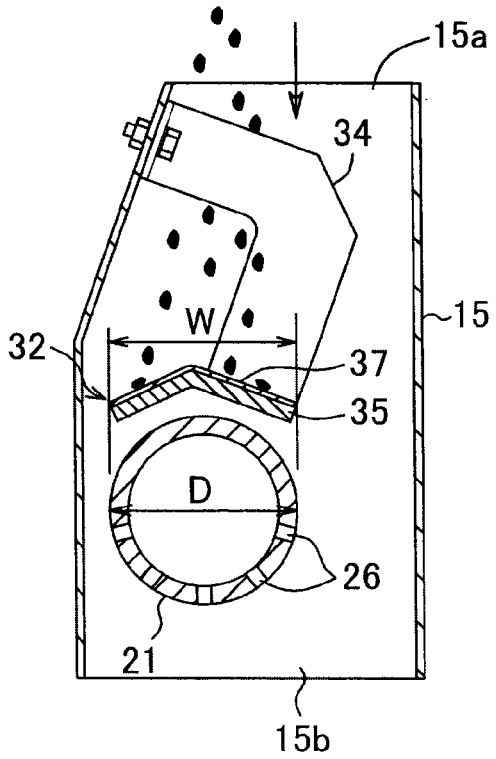
FIG. 4 is an enlarged sectional view taken along the line IV-IV in FIG. 2.

The intra-duct portion 21 has: a distal end which is a right end in FIG. 2, i.e., a downstream end; and a basal end which is a left end in FIG. 2, i.e., an upstream-side end. The distal end of the intra-duct portion 21 is detachably attached to the duct 15 through a pipe-side bracket 27 and a duct-side bracket 28 which brackets are interconnected by a bolt 29 and a nut 30. The basal end of the intra-duct portion 21 is fitted into the distal end of the second segment 23 of the ex-duct portion 20 within the duct 15 and connected thereto by a clip 31 in a disconnectable and re-connectable manner. The basal end of the intra-duct portion 21 is thus supported by the duct 15 via the second segment 23 and the support plate 25.

The above-mentioned gas release apparatus allows the following advantageous effects to be obtained.

(I) The exhaust-gas pipe 17, separated into the ex-duct portion 20 fixed to the engine vibration system and the intra-duct portion 21 fixed to a machine-body vibration system, can be restrained from being vibrated. In addition, fixation of the intra-duct portion 21 to the duct 15 prevents the exhaust-gas pipe 17 from resonance as a whole. The exhaust-gas pipe 17 is thus prevented from breakage due to vibration and allowed to have enhanced durability.

(II) The fixation of the intra-duct portion 21 of the exhaust-gas pipe 17 to the duct 15 enables the intra-duct portion 21 and further the entire exhaust-gas pipe 17 to have increased strength. In particular, mounting the left and right ends (i.e., upstream and downstream ends) of the intra-duct portion 21 to the duct 15 enables a vibration suppression effect and a strength increase effect to be further enhanced.

(III) The intra-duct portion 21, in which the basal end thereof is connected to the second segment 23 of the ex-duct portion 20 in a disconnectable and re-connectable manner while the distal end thereof is detachably attached to the duct 15 via the pipe-side and duct-side brackets 27, 28, allows both attachment and detachment operations of the intra-duct portion 21 with respect to the ex-duct portion 20 and with respect to the duct 15 to be performed within the duct 15. The attachment and detachment operations of the intra-duct portion 21 for maintenance, etc., therefore, can be easily performed by utilization of a bottom opening, namely, the exhaust air outlet 15*b*, of the duct 15 and the gas release port 16.

(IV) The ex-duct portion 20 of the exhaust-gas pipe 17, longitudinally divided into the first segment 22 connected to the muffler 14 and the second segment 23 connected to the intra-duct portion 21, can be further restrained from being vibrated.

(V) The loose insertion of the distal end of the first segment 22 into the basal end of the second segment 23 with the diametrical gap S, for interconnection of the first and second segments 22, 23, enables the adjustment of relative positions of the first and second segments 22, 23 to each other in the length direction, i.e., the adjustment of an overall length of the ex-duct portion 20, and the adjustment of the relative positions thereof in the diametrical direction within the range corresponding to the dimension of the gap S to be performed. This allows relative positions of the muffler 14 and the ex-duct portion 20 to each other and relative positions of the ex-duct portion 20 and the intra-duct portion 21 to be easily adjusted, which permits fabrication errors and assembling errors of the ex-duct portion 20, the intra-duct portion 21, the muffler 14 and the duct 15. Besides, even if the first segment 22 belonging to the engine vibration system resonates, the gap S can prevents vibration of the first segment 22 from being transmitted to the second segment 23. This effect can also be obtained by interconnecting the first and second segments 22, 23 via a bellows-shaped member.

(VI) The distal end of the first segment 22, forming the tapered nozzle portion 22*a*, can increase a flow speed of exhaust gas to thereby prevent the exhaust gas from backflow and further leakage through each of the connection regions due to the backflow.

The gas release apparatus according to this embodiment further comprises, as an additional feature thereof, an exhaust-gas-pipe cover 32 for protecting the exhaust-gas pipe 17, more specifically, for protecting the intra-duct portion 21. The exhaust-gas-pipe cover 32 is provided inside the duct 15 at a position spaced apart upwardly from the intra-duct portion 21 of the exhaust-gas pipe 17 to prevent oil (fuel oil or hydraulic oil; indicated by black dots in FIGS. 1 and 4) dropping down from a device 33, such as a water separator or a fuel filter, located just above the duct 15 as shown in FIG. 1, from coming into contact with the intra-duct portion 21.

The exhaust-gas-pipe cover 32 includes a cover body 37 formed of a thin and long plate member extending along the intra-duct portion 21 and a pair of attaching arms 34. The cover body 37 has an inverted V-shaped cross-section, specifically, a cross-section having front and rear portions on both sides of a center line of the intra-duct portion 21 of the exhaust-gas pipe 17 in top plan view which portions are inclined from a base edge thereof just above the center line toward a distal edge thereof. The cover body 37 has right and left ends, and the attaching arms 34 protrude upwardly from the right and left ends of the cover body 37, respectively. The attaching arms 34 are bolted to the back wall portion of the duct 15, individually, thus allowing the cover body 37 to be disposed in such a posture that the cover body 37 extends along the length direction of the intra-duct portion 21 and in parallel relation to the intra-duct portion 21 while forming a constant gap between the cover body 37 and the intra-duct portion 21.

The intra-duct portion 21 has a diameter dimension D which is set, with respect to a width dimension W of the cover body 37 of the exhaust-gas-pipe cover 32, so as to establish the relationship: D=W. In other words, the intra-duct portion 21 and the exhaust-gas-pipe cover 32 are relatively arranged in such a manner that the intra-duct portion 21 does not protrude beyond the cover body 37 in top plan view, and the cover body 37 does not protrude beyond the intra-duct portion 21 in bottom view. The two dimensions D and W, alternatively, may be set to establish the following relationship: D<W, within a slight difference therebetween.

The exhaust-gas-pipe cover 32 is disposed not so as to cover the intra-duct portion 21 over the overall length thereof but so as to cover only a specific region of the overall length of the intra-duct portion 21 as shown in FIGS. 1 and 2, specifically, only a part of the overall length of the intra-duct portion 21, the part including a region to which oil can drop down from the device 33 located thereabove.

The apparatus further includes a heat insulating material 35 such as glass wool. The heat insulating material 35 is formed to have a given thickness, and fixed to a lower surface of the cover body 37.

The exhaust-gas-pipe cover 32 further allows the following advantageous effects to be obtained.

(1) The exhaust-gas-pipe cover 32 effectively protects the intra-duct portion 21 against oil dropping down from the device 33 located thereabove during maintenance or the like, specifically, prevents the oil from contact with the intra-duct portion 21 in a high temperature state with a possibility of ignition. This effect will be more specifically described, in comparison with a reference example shown in FIG. 9, imaginarily prepared only for the sake of explanation therefor. This reference example is an example including an exhaust-gas pipe 8 and a duct 9*a* having respective structures and arrangements changed from that of the exhaust-gas pipe 8 and the duct 9 in the conventional gas release apparatus shown in FIG. 8 so as to improve mixing between exhaust gas flowing through the exhaust-gas pipe 8 and exhaust air flowing through the duct 9.

Figure 9:
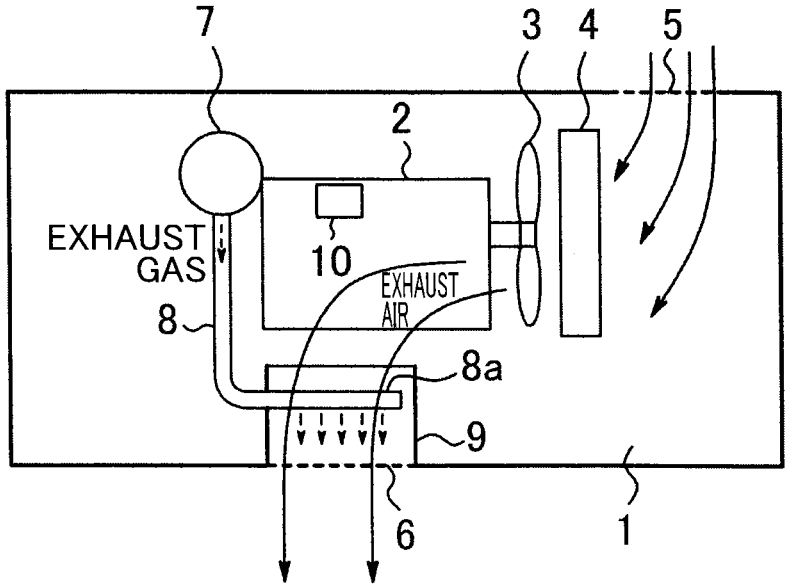
FIG. 9 is a schematic sectional view showing a gas release apparatus as a reference example for explaining the present invention.

The duct 9 according to the reference example shown in FIG. 9 is disposed to allow exhaust air to pass through a region of an engine room 1 just below an engine 2, in an up-down direction. Specifically, the duct 9 has an upper end opened inside of the engine room 1 and a lower end forming a gas release port 6. The exhaust-gas pipe 8 shown in FIG. 9 has an intra-duct portion 8*a* which is a horizontally extending distal end portion. The intra-duct portion 8*a* is disposed inside the duct 9 approximately across the duct 9, that is, in a posture approximately perpendicular to the exhaust air.

Figure 8:
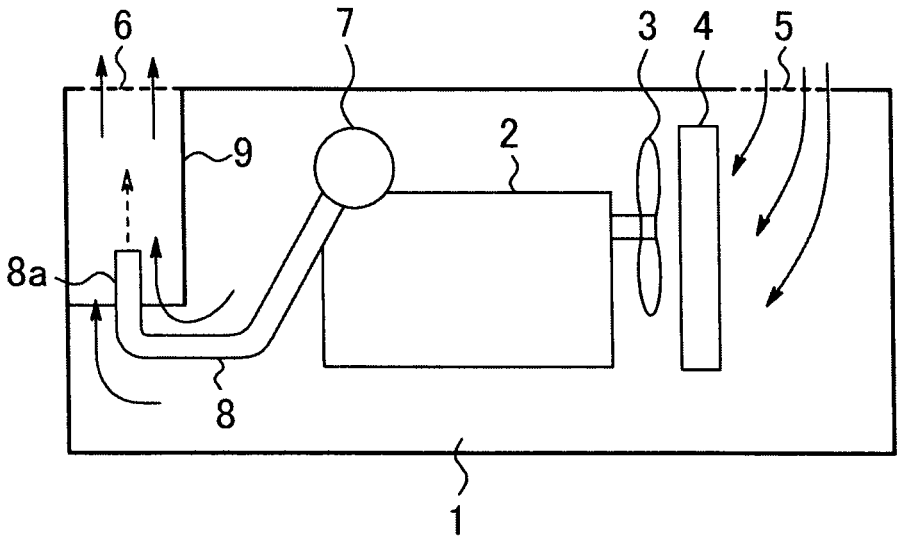
FIG. 8 is a sectional view showing a conventional gas release apparatus.

According to this reference example, differently from the conventional apparatus shown in FIG. 8, exhaust gas is dispersedly ejected into the duct 9, thus being mixed with the exhaust air in a large areal range. This improves mixing efficiency and enhances an exhaust gas temperature lowering effect. Besides, the diffusion of the exhaust gas in the duct 9 enables a sound reduction effect in the duct 9 to be improved also due to sound attenuation by means of reflection at an inner surface of the duct.

However, the reference example shown in FIG. 9, where the duct 9 has an exhaust air inlet at the upper end thereof and the exhaust air inlet is opened beneath the engine 2, has a possibility of the following trouble: in a situation where an engine-related device (e.g., a water separator or a fuel filter) 10 is disposed just above the duct 9 and oil (fuel oil or hydraulic oil) can leak during maintenance or the like, the oil having leaked out from the device 10 may drop down to the ejection portion 8*a* of the exhaust-gas pipe 8, thus generating a possibility of ignition on the ejection portion 8*a* during maintenance or during subsequent excavator operation.

The exhaust-gas-pipe cover 32 can prevent such problem in the reference example.

(2) The exhaust-gas-pipe cover 32, provided inside the duct 15, cannot exert a negative influence on layout of other devices or members, or cannot generate necessity for downsizing the duct 15 to avoid the above negative influence, differently from the case of providing the exhaust-gas-pipe cover outside the duct 15.

(3) The cover body 37 of the exhaust-gas-pipe cover 32, having a thin and long plate shape and extending along the length direction of the intra-duct portion 21, allows the exhaust-gas-pipe cover 32 to have a reduced projected area in top plan view to thereby suppress an increase in airflow resistance in the duct 15 due to the exhaust-gas-pipe cover 32. In addition, it is possible to limit the space occupied by the exhaust-gas-pipe cover 32 in the duct 15 to a specific range just above the intra-duct portion 21. Hence, the provision of the exhaust-gas-pipe cover 32 does not involve reduction in an installation space for a member inside the duct 15 other than the exhaust-gas-pipe cover 32, or an upsize in the duct 15.

(4) The cover body 37 of the exhaust-gas-pipe cover 32, having a shape of covering only a part of the overall length of the intra-duct portion 21 which part includes a region to which oil can drop down from above, can protect the intra-duct portion 21 from oil, while having a reduced length to reduce the airflow resistance and the occupied space.

(5) The cover body 37 of the exhaust-gas-pipe cover 32, having a width dimension W approximately equal to a diameter D of the intra-duct portion 21 and being disposed so as to prevent the intra-duct portion 21 from protruding beyond the cover body 37 in top plan view, can protect the intra-duct portion 21, while minimizing an increase in airflow resistance due to the exhaust-gas-pipe cover 32 to ensure a required air volume performance.

(6) The cover body 37 of the exhaust-gas-pipe cover 32, having a shape in which each of the front and rear portions of the cover body 37 on both sides of the center line of the exhaust-gas pipe 21 in top plan view is inclined toward a distal edge thereof, allows exhaust air flowing downwardly from the upper side of the cover body 37 to smoothly pass the exhaust-gas-pipe cover 32 along the inclined front and rear portions thereof, thereby enabling the airflow resistance to be further reduced.

(7) The heat insulating material 35 fixed to the lower surface of the cover body 37 of the exhaust-gas-pipe cover 32 suppresses a rise in surface temperature of the exhaust-gas-pipe cover 32 itself, thereby allowing safety for a worker who touches the exhaust-gas-pipe cover 32 during maintenance or the like to be ensured.

Figure 5:
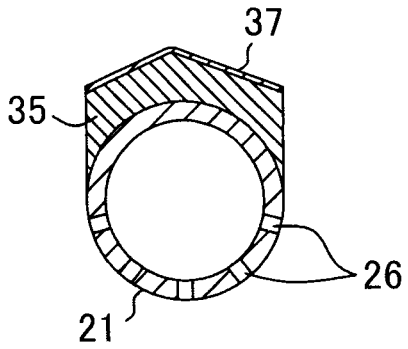
FIG. 5 is a sectional view of an exhaust-gas pipe and an exhaust-gas-pipe cover in a gas release apparatus according to a second embodiment of the present invention.

FIG. 5 shows a gas release apparatus according to a second embodiment of the present invention. The apparatus comprises an exhaust-gas-pipe cover 32 including a cover body 37 and a heat insulating material 35, similarly to the first embodiment, while the heat insulating material 35 is provided so as to fill a gap between the under surface of the cover body 37 and an upper surface of an intra-duct portion 21. This arrangement of the heat insulating material 35 enhances the heat-insulating property of exhaust-gas-pipe cover 32 and prevents exhaust air from turning around into the region between the cover body 37 and the intra-duct portion 21 to thereby further smoothen a flow of the exhaust air and further reduce the airflow resistance.

Figure 6:
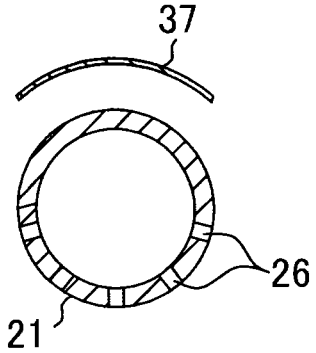
FIG. 6 is a sectional view of an exhaust-gas pipe and an exhaust-gas-pipe cover in a gas release apparatus according to a third embodiment of the present invention.

FIG. 6 shows a gas release apparatus according to a third embodiment of the present invention. The apparatus comprises an exhaust-gas-pipe cover 32 with a cover body 37, similarly to the first embodiment, while the cover body 37 has an arc-shaped cross-section. Thus shaped cover body 37 allows exhaust air flowing downwardly from above to be smoothly diverged toward front and rear sides of the cover body 37 along the arc-shaped upper surface thereof, thereby enabling the airflow resistance to be further reduced.

Figure 7:
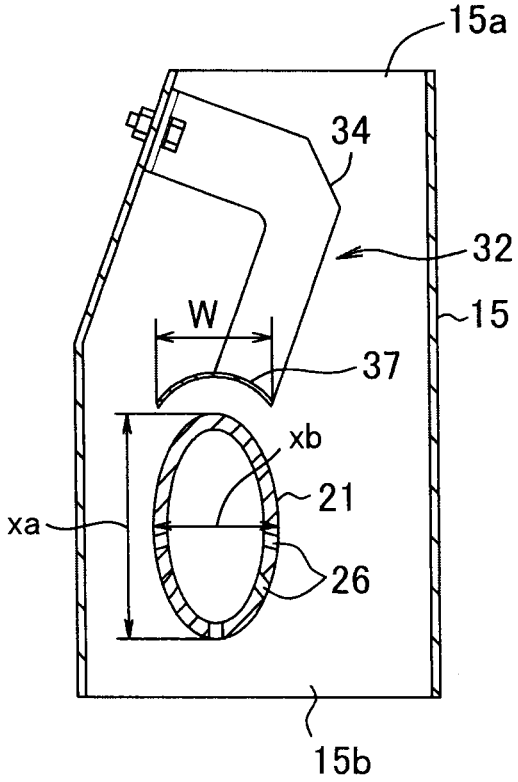
FIG. 7 is a sectional view showing a gas release apparatus according to a fourth embodiment of the present invention, the sectional view corresponding to FIG. 4.

FIG. 7 shows a gas release apparatus according to a fourth embodiment of the present invention. The apparatus also comprises an exhaust-gas pipe 17 having an intra-duct portion 21, while the intra-duct portion 21 has an elliptical-shaped cross-section and disposed inside a duct 15 so as to be in a vertically long, flattened shape, more specifically, so as to make the direction of the major axis Xa of the ellipse be coincident with a flow direction of exhaust air, that is, so as to make the direction of the minor axis Xa of the ellipse be perpendicular to the flow direction of exhaust air. Comparing the intra-duct portion 21 in the fourth embodiment to an intra-duct portion having a circular-shaped cross-section like the intra-duct portion 21 according to the first to third embodiment, on an assumption that they have the same cross-sectional area, the intra-duct portion 21 in the fourth embodiment has an advantage of having a small projected area thereof in top plan view to thereby make a ratio of the intra-duct portion 21 to the duct 15 in terms of a horizontal cross-sectional area, i.e., a level of airflow resistance, be small. In addition, the thus intra-duct portion 21 can allow a width dimension W of a cover body 37 of an exhaust-gas-pipe cover 32 to be small in conformity to a dimension of the minor axis Xa of the intra-duct portion 21, thereby enabling the suppression of an increase in airflow resistance to be more effective.

Alternatively, as a variation of the fourth embodiment, the intra-duct portion 21 may be divided into a plurality of pipe members each having a relatively small diameters, on an assumption that a total cross-sectional area of the pipe members is equal to the cross-sectional area of the intra-duct portion 21 in the first embodiment, wherein the pipe members are vertically spaced and overlapped to each other in top plan view, inside the duct 15. This configuration also enables fundamentally the same effect as that in the fourth embodiment to be obtained.

Although FIGS. 6 and 7 has no indication about a heat insulating material, there may be actually provided a heat insulating material having a given thickness on a lower surface of the cover body 37 as in the first embodiment, or a heat insulating material filling a gap between the lower surface of the cover body 37 and an upper surface of the intra-duct portion 21. Besides, it is also permitted to change a cross-sectional shape of the cover body 37 of the exhaust-gas-pipe cover 32 in the fourth embodiment shown in FIG. 7 into any other suitable cross-sectional shape, for example, an inverted V shape.

The exhaust-gas-pipe cover of the present invention may be configured to cover the intra-duct portion of the exhaust-gas pipe over the overall length thereof.

The present invention may be implemented in not only a hydraulic excavator but also any other construction machine equipped with an engine room and configured to release cooling air and exhaust gas, from the engine room to the outside.

As above, the present invention provides a gas release apparatus for a construction machine, capable of excellently mixing exhaust gas discharged from an engine with exhaust air to thereby improve lowering temperature of the exhaust gas and suppression of noise. Provided by the present invention is an apparatus which is provided in a construction machine equipped with an engine and an engine room housing the engine to release exhaust gas of the engine to an outside of the engine room. The apparatus comprises: a duct provided inside the engine room at a position beneath the engine, the duct having an upper end which surrounds an exhaust air inlet; a cooling fan configured to cause air outside the engine room to be sucked into the engine room as cooling air and then released as exhaust air to an outside of the engine room through the duct; an exhaust-gas pipe designed to introduce exhaust gas of the engine into the duct and having an intra-duct portion which extends, in the duct, in a length direction approximately perpendicular to a flow direction of the exhaust air passing through the duct, the intra-duct portion having a plurality of ejection holes spaced in the length direction to allow the exhaust gas to be ejected into the duct through the ejection holes to thereby let the ejected exhaust gas be released to the outside together with the exhaust air; and an exhaust-gas-pipe cover provided inside the duct at a position upwardly apart from the intra-duct portion to protect the intra-duct portion from oil which can drop down to the intra-duct portion.

The exhaust-gas-pipe cover, provided inside the duct at a position just above the intra-duct portion of the exhaust-gas pipe to protect the intra-duct portion against oil dropping down from a device located above, can prevent the oil from contact with the intra-duct portion having a high temperature state to cause ignition. Furthermore, the exhaust-gas-pipe cover, provided inside the duct, cannot exert a negative influence on layout of other devices or members or cannot generate a necessity for downsizing the duct to avoid the negative influence, differently from an exhaust-gas-pipe cover provided outside the duct.

Preferably, the exhaust-gas-pipe cover includes a plate-shaped cover body extending along the length direction of the intra-duct portion of the exhaust-gas pipe. The thus shaped cover body can have a small projected area in top plan view, which can suppress an increase in airflow resistance in the duct due to the exhaust-gas-pipe cover. In addition, the exhaust-gas-pipe cover can occupy only a space, in the duct, limited to a range just above the intra-duct portion. This prevents the exhaust-gas-pipe cover from involving a need for diminishing a space for installing a member other than the exhaust-gas-pipe cover inside the duct or for an increase in size of the duct.

In this apparatus, more preferable is that the cover body of the exhaust-gas-pipe cover is provided so as to cover only a part of an overall length of the intra-duct portion, the part including a region onto which oil can drop down. This makes it possible to protect the intra-duct portion while reducing a length of the cover body of the exhaust-gas-pipe cover to thereby reduce the airflow resistance and the occupied space.

The cover body of the exhaust-gas-pipe cover, preferably, has a width dimension approximately equal to a diameter of the intra-duct portion of the exhaust-gas pipe, and the exhaust-gas pipe is provided so as to prevent the intra-duct portion from protruding beyond the cover body, in top plan view. This makes it possible to ensure a required air volume performance, particularly, by minimizing an increase in airflow resistance due to the exhaust-gas-pipe cover.

Preferably, the cover body of the exhaust-gas-pipe cover has a cross-section with a shape in which each of two portions of the cover body on both sides of a center line of the intra-duct portion of the exhaust-gas pipe in top plan view is inclined toward a distal edge thereof. The cross-sectional shape allows exhaust air flowing downwardly from the upper side of the cover body to smoothly pass the exhaust-gas-pipe cover along the thus inclined portions thereof, thereby enabling the airflow resistance to be further reduced. This advantageous effect is prominent in the case where the cross-section has an arc shape.

Preferably, the apparatus further comprises a heat insulating material fixed to a lower surface of the cover body. The heat insulating material suppresses a rise in surface temperature of the cover body, thereby ensuring safety for a worker who touches the cover body during maintenance or the like.

In this apparatus, more preferable is that the heat insulating material is provided so as to fill a gap between the lower surface of the cover body and an upper surface of the intra-duct portion of the exhaust-gas pipe. The thus arranged heat insulating material can not only enhance the insulating property of the exhaust-gas pipe but also prevent air from turning around into the region between the cover body and the intra-duct portion to further smoothen a flow of the exhaust air and thereby allow the airflow resistance to be further reduced.

This application is based on Japanese Patent application No. 2013-214358 filed in Japan Patent Office on Oct. 15, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine comprising:

an engine;

an engine room housing the engine to release exhaust gas of the engine to an outside of the engine room;

a duct provided inside the engine room at a position beneath the engine, the duct having an upper end which surrounds an exhaust air inlet which is opened upward;

a muffler provided inside the engine room at a position outside of the duct and connected to the engine so as to allow the exhaust gas to be discharged from the engine through the muffler;

a cooling fan configured to cause air outside of the engine room to be sucked into the engine room as cooling air and then released as exhaust air to the outside of the engine room through the duct;

an exhaust-gas pipe connected to the muffler to introduce the exhaust gas of the engine discharged through the muffler into the duct and having an intra-duct portion which extends, in the duct, in a length direction approximately perpendicular to a flow direction of the exhaust air passing through the duct, the intra-duct portion having a plurality of ejection holes spaced in the length direction to allow the exhaust gas discharged through the muffler to be ejected into an inside of the duct through the ejection holes to thereby let the ejected exhaust gas be released to the outside of the engine room together with the exhaust air; and an exhaust-gas-pipe cover provided inside the duct at a position beneath the exhaust air inlet of the duct and upwardly apart from the intra-duct portion to protect the intra-duct portion from oil which can drop down to the intra-duct portion through the upward opened exhaust air inlet.

2. The construction machine as defined in claim 1, wherein the exhaust-gas-pipe cover includes a plate-shaped cover body extending along the length direction of the intra-duct portion of the exhaust-gas pipe.

3. The construction machine as defined in claim 2, wherein the cover body of the exhaust-gas-pipe cover is provided so as to cover only a part of an overall length of the intra-duct portion, the part including a region onto which oil can drop down.

4. The construction machine as defined in claim 2, wherein the cover body of the exhaust-gas-pipe cover has a width dimension approximately equal to a diameter of the intra-duct portion of the exhaust-gas pipe, and wherein the intra-duct portion of the exhaust-gas pipe is provided in such a manner as to be kept from protruding from the cover body, in top plan view.

5. The construction machine as defined in claim 2, wherein the cover body of the exhaust-gas-pipe cover has a cross-section with a shape in which each of two portions of the cover body on both sides of a center line of the intra-duct portion of the exhaust-gas pipe in top plan view is inclined toward a distal edge of the portion.

6. The construction machine as defined in claim 5, wherein the cover body has an arc-shaped cross-section.

7. The construction machine as defined in claim 2, further comprising a heat insulating material fixed to a lower surface of the cover body.

8. The construction machine as defined in claim 7, wherein the heat insulating material is provided in such a manner as to fill a gap between the lower surface of the cover body and an upper surface of the intra-duct portion of the exhaust-gas pipe.

* * * * *